United States Patent [19]

Nightingale et al.

[11] 4,025,413

[45] May 24, 1977

[54] ELECTROLYTIC REFINING OF METAL

[75] Inventors: Colin Walter Nightingale, Formby; Georg Paul Richard Bielstein, London, both of England

[73] Assignee: British Copper Refiners Limited, Prescot, England

[22] Filed: June 23, 1975

[21] Appl. No.: 589,353

Related U.S. Application Data

[62] Division of Ser. No. 396,550, Sept. 12, 1973, Pat. No. 3,928,151.

[52] U.S. Cl. ..... 204/252; 204/DIG. 7; 204/106; 204/108; 204/228; 204/267; 204/279

[51] Int. Cl.[2] ..... C25C 1/12; C25C 7/00

[58] Field of Search ..... 204/252, 250, 261, 263, 204/273, 275, 279, 106, 108, 288, 289, 297, DIG. 7, 228, 229, 267

[56] References Cited

UNITED STATES PATENTS

| | | | |
|---|---|---|---|
| 780,191 | 1/1905 | Johnson | 204/275 X |
| 2,682,505 | 6/1954 | Greco | 204/284 |
| 3,558,455 | 1/1971 | Sorensen et al. | 204/269 X |
| 3,679,568 | 7/1972 | Westerlund | 204/279 X |

*Primary Examiner*—Arthur C. Prescott

*Attorney, Agent, or Firm*—Webb, Burden, Robinson & Webb

[57] ABSTRACT

Apparatus for electrolytically refining copper by the series process comprises a tank having an inner surface of an electrically insulating synthetic polymeric material that is substantially inert to an electrolyte solution to be contained in the tank and, associated with the tank, baffles for reducing current flow that would otherwise occur around the edges of electrodes when immersed in the electroltye solution. These baffles comprise sheets of an electrically insulating material that is inert to the electrolyte solution. A pair of such sheets constitutes side baffles each of such a shape and size that it can be positioned with its major surfaces vertical between side edges of a group of electrodes when immersed in the tank and a neighboring side wall of the tank throughout the length of the group. A plurality of such sheets constituting bottom baffles form a self-supporting lattice work structure and are so arranged and of such a shape and size that, when the lattice-work structure rests on the base of the tank, the bottom baffles will be mutually spaced along the length of the tank and will be positioned with their major surfaces vertical in the gap between the base of the tank and the bottom edges of electrodes when immersed in the tank with each bottom baffle extending transversely of the tank throughout substantially the whole of the width of the electrodes.

13 Claims, 4 Drawing Figures

ELECTROLYTIC REFINING OF METAL

This application is a divisional of U.S. Pat. application Ser. No. 396,550, filed Sept. 12, 1973 now U.S. Pat. No. 3,928,151.

This invention relates to the method of refining copper in which plates of the metal to be refined form electrodes, hereinafter referred to as unrefined electrodes, in an electrolytic cell, usually containing an aqueous solution of copper sulphate acidified with sulphuric acid.

In the Specification of our British Pat. No. 1,067,297 there is described and claimed a method of electrolytically refining copper which comprises forming a copper strip of indefinite length by a continuous casting process, cutting this strip into lengths such that plates having the required superficial area are formed, preferably of at least 0.74 sq. m. (8 sq. ft.), immersing the cut lengths as unrefined electrodes in an electrolyte solution and passing a direct current through the electrolyte to cause copper to be dissolved from the unrefined electrodes and deposited as pure copper.

Owing to their method of manufacture, the unrefined electrode plates have flatter and smoother surfaces and are more accurate in all their dimensions than electrodes cast in conventional open moulds and can, therefore, be satisfactorily used in sizes larger than it is economically possible to use with electrodes cast individually in open moulds and/or they can be packed closer together than such electrodes, thus reducing the superficial area of the tank and/or the consumption of power for a given output of refined copper.

The advantages provided by unrefined electrode plates formed by a continuous casting process render these electrodes especially suitable for use in the series process of electrolytically refining copper, that is the process in which a plurality of unrefined electrodes are supported in the electrolyte solution, all of a group of said electrodes except the first and last are bipolar, and a direct current enters the group at the first electrode or anode at the positive end of the group, generally travels from each intermediate electrode through the electrolyte solution to the next in line and so forth until it leaves the group at the last electrode or cathode at the negative end of the group. In this way impure copper is dissolved from one side of each intermediate electrode and pure copper is deposited on the other side of the electrode. Because copper is not dissolved from one side of the last electrode or cathode, this plate, generally called the starting cathode, is customarily of pure metal and is initially thinner than the intermediate electrodes.

Although unidirectional direct current is normally used in the series process, the term "series process" as used herein is not intended to exclude series processes in which the current is reversed for short periods.

Owing to the large number of electrodes generally immersed in the electrolyte in the series process the voltage applied between the anode and cathode electrodes of the series is relatively high, usually in the order of 80V, and in order to prevent current-leakage through the walls of the tank containing the electrolyte it has been the practice in operating the series process to make the tank of, or to line the tank with, an electrically insulating material. Hitherto tanks for use in the series process have been moulded from a mixture of asbestos, asphalt and sand or have been lined with a mixture of asphalt, mastic and blown oil, but these insulating materials have the serious disadvantage that due to their relatively low softening temperatures, the temperature at which the electrolyte can be maintained is limited, usually to a temperature below 45° C (113° F). By so limiting the temperature at which the electrolyte is maintained, the consumption of power for a given output of refined copper can sometimes be so high that the use of the series process can be rendered uneconomical in spite of its other inherent advantages.

Furthermore, in the electrolytic refining of copper by the series process it is advantageous to arrange for the gaps between the immersed edges of the electrodes and the neighbouring walls of the tank to be as a small as possible because a gap of unnecessary dimension adversely affects the electrical efficiency of the process, there being less tendency for direct current to flow around the immersed edges of electrodes when the gap is small. However, with regard to the gaps between the immersed bottom edges of the electrodes and the base of the tank, with a view to preventing slime which is released from the impure copper and which settles on the base of the tank from shorting adjacent electrodes as it accumulates and to ensure that flow of electrolyte solution is not impeded, it is the general practice to support the electrodes in the tank in such a way that their bottom edges are spaced a substantial distance from the base of the tank, this distance normally being in the region of 300 mm. A gap of such size adversely affects the electrical efficiency of the series process because there is a tendency for direct current to flow around the bottom edges of the electrodes. Furthermore, with regard to the gaps between the immersed side edges of the electrodes and the side walls of the tank, it is the general practice to space side edges of the electrodes a substantial distance from the neighbouring side wall of the tank, usually in the region of 100 mm, because if the width of the electrodes having regard to the width of the tank is arranged to be such that the gaps between the side edges of the electrodes and the neighbouring side walls of the tank are small, then since when a large number of electrodes, either in a single group or in two or more smaller groups, are lowered into or raised from the tank by means of a crane or other overhead support, it is difficult to ensure that the side edges of the suspended electrodes are maintained in substantial alignment, as electrodes are lowered into or raised from the tank there is a danger that side edges of some of the electrodes will score or otherwise damage the inner surfaces of the tank. Since in the case of the series process the inner surface of the tank is of, or lined with, electrically insulating material, the fact that the inner surface of the insulating material is liable to be damaged in this way may effect an increase in the frequency with which such insulating tank linings have to be maintained.

It is an object of the invention to provide improved apparatus for electrolytically refining copper by the series process in which the consumption of power for a given output of refined copper is substantially less than that in series processes hitherto employed, in which the electrical efficiency can be arranged to approach the optimum, and in which the risk of side edges of electrodes damaging the inner surface of a tank when the electrodes are lowered into or raised from the tank is substantially reduced.

In accordance with the invention the apparatus comprises a tank having an inner surface of an electrically insulating synthetic polymeric material that is substantially inert to an electrolyte solution to be contained in the tank and, associated with the tank, baffles for substantially reducing current flow that would otherwise occur around at least some of the edges of electrodes when immersed in the electrolyte solution, which baffles comprise sheets of an electrically insulating material that is substantially insert to the electrolyte solution, wherein said baffles include a pair of side baffles of such a shape and size that each can be positioned between side edges of electrodes when immersed in the tank and a neigbouring side wall of the tank throughout substantially the whole length of a group of electrodes with its major surfaces substantially vertical, and a plurality of bottom baffles in the form of a self-supporting lattice-work structure, the bottom baffles being so arranged and of such a shape and size that when the lattice-work structure rests on the base of the tank, the bottom baffles will be mutually spaced along the length of the tank and will be positioned with their major surfaces substantially vertical in the gap between the base of the tank and the bottom edges of electrodes when immersed in the tank, with each bottom baffle extending transversely of those walls of the tank which will be adjacent the side edges of the electrodes throughout at least substantially the whole of the width of the electrodes.

The high softening temperatures of synthetic polymeric insulating materials as compared with those of the insulating materials hitherto used for forming the inner surfaces of tanks used in the series process permit the electrolyte solution to be maintained at a temperature substantially higher than the temperature generally employed in an otherwise equivalent process with the result that the consumption of power is substantially reduced, thereby reducing the cost of a given output of copper.

Preferably the tank has an inner lining of insulating polymeric material secured to the wall of the tank and this lining is preferably made of polyvinylchloride. Where the lining is of polyvinyl chloride the thickness of the lining is at least 3.2 mm (⅛ in) and the electrolyte solution is preferably maintained at a temperature of at least 63° C (145° F). Other synthetic materials of which the inner surface of the tank may be formed include polythene, polypropylene, a co-polymer of acrylonitrile, butadiene and styrene, a modification of this co-polymer, and other synthetic polymeric materials containing at least the chemical elements of carbon and hydrogen.

Another advantage of using tank linings of synthetic polymeric insulating material lies in the fact that such linings require substantially less maintenance than linings of mastic compositions hitherto used and, therefore, provide a further reduction in the overall cost of manufacture of electrolytically refined copper.

The unrefined electrodes may be supported in the electrolyte solution by any convenient means, for example by suspending the electrodes from a bar by means of riveted straps or hooks passing through holes or into notches formed in the upper part of the electrode so that a major portion of each electrode is immersed in the electrolyte solution or so that each electrode is totally immersed in the electrolyte solution.

The baffles that substantially reduce current flow around immersed side edges of electrodes preferably comprise sheets of a rigid, semi-rigid or resilient electrically insulating material.

In the event that side edges of a group of electrodes being introduced into the tank are not in substantial alignment with the tank, the projecting side edges will be prevented from scoring or otherwise damaging the inner surface of the tank by the intervening side baffle of insulating material which is expendable and can be replaced if it is damaged by side edges of electrodes to such an extent that it can no longer serve the purpose for which it was intended. The thickness of each side baffle in relation to the distance between the side edges of the electrodes and the neighbouring side wall of the tank will not be so great as to impede to an undesirable extent flow of the electrolyte solution.

The baffles that substantially reduce current flow around the immersed bottom edges of electrodes also preferably comprise sheets of a rigid, semi-rigid or resilient electrically insulating material.

Slime released from the impure copper is permitted to sink between the bottom baffles and to settle on the base of the tank. Preferably the upper edges of the bottom baffles are approximately level with or are slightly below the bottom edges of the electrodes and each of these upper edges is preferably chamfered or otherwise so shaped as to reduce the tendency for slime to settle upon it. Preferably, also, the bottom baffles extend parallel or approximately parallel to the electrodes and in this case the spacing between the adjacent bottom baffles is preferably less than that between adjacent electrodes so that there is always at least one bottom baffle positioned below and between each adjacent pair of electrodes.

Since the side baffles serve to reduce substantially the tendency for direct current to flow around immersed side edges of electrodes and the bottom baffles serve to reduce substantially the tendency for direct current to flow around the immersed bottom edges of electrodes, the electrical efficiency of the series refining process is substantially increased.

Each sheet of rigid, semi-rigid or resilient insulating material constituting a baffle is preferably of solid form, but the use of a perforated sheet or of a sheet of open-work or mesh-like form is not excluded from the invention. Preferably the baffles comprise an insulating synthetic polymeric material, for instance a polyvinyl chloride composition; other polymeric materials of which the baffles may be formed include polythene, polypropylene, co-polymers of acrylonitrile, butadiene and styrene, modifications of these co-polymers and synthetic polymeric materials containing at least the chemical elements of carbon and hydrogen.

Preferably the lattice-work structure comprises transversely extending bottom baffles interconnected by, or integral with, a pair of longitudinally extending elongate members of a rigid, semi-rigid or resilient electrically insulating material, each of which extends along the length of the tank adjacent to a side wall of the tank and is supported on the base of the tank. Each of these elongate members is preferably in the form of a strip which is arranged with its major surfaces vertical or approximately vertical. The bottom edges of the bottom baffles and longitudinally extending strips may be spaced from the base of the tank over the whole or part of their lengths to permit slime to settle more readily on the base of the tank. Alternatively, the bottom edges of the bottom baffles and longitudinally extending strips may be integral with, or connected to, a base wall of rigid, semi-rigid or resilient electrically insulating material separable from the tank, thereby forming a removable inner container into which slime settles. In the series process bottom baffles integral with, or connected to, a base wall separable from the tank serve to reduce substantially the risk of "copper-bottoming" occurring, that is to say the formation of a longitudinally continuous path of copper deposited on electrically conductive slime which has settled along the base of the tank, because the bottom baffles interrupt the electrical continuity of the slime along the tank. The upper edge of each longitudinally extending strip may extend above the upper edges of the bottom baffles and may be so shaped as to provide support for the bottom edges of the electrodes.

Where the bottom edges of the bottom baffles are integral with, or connected to, a base wall separable from the tank, this base wall may be of sufficient thickness to protect from mechanical damage the base wall of the tank in the event that an electrode supported above the bottom baffles should inadvertently drop between two adjacent bottom baffles. Alternatively, or additionally, one or each neighbouring major surface of each adjacent pair of bottom bafles may have projecting outwardly from the surface for a part but not the whole of the distance between these major surfaces, at least one fin arranged with its major surfaces vertical or approximately vertical, the or each projecting fin serving to support on its upper edge an electrode should the electrode inadvertently drop between two adjacent bottom baffles, thereby providing protection against mechanical damage for the base wall of the tank. An alternative self-supporting lattice-work structure which will also provide protection for the base wall of the tank against mechanical damage should an electrode inadvertently drop from its supporting means, may be in a form similar to that of a honeycomb and comprise two sets of transversely extending bottom baffles, the baffles of each set being inclined at an angle to one another and to the electrodes. In all cases the upper edges of the bottom baffles and, when present, the longitudinally extending strips and/or projecting fins are preferably chamfered or otherwise so shaped as to reduce the tendency for slime to settle on them.

The side baffles are each preferably suspended in the electrolyte solution by means of hooks or other means carried on the upper edge of the sheet constituting the side baffle and engaging the upper edges of the electrodes or the means supporting the electrodes and in this case the side baffles will be suspended from the electrodes or their means of support as the electrodes are introduced into the tank. When so suspended the side baffles will be immediately adjacent the side edges of the electrodes. Alternatively, the side baffles may be suspended from the rim of the tank wall.

In a further alternative construction, along the whole or at spaced positions along its bottom edge, each side baffle may be integral with or connected to one of the longitudinally extending elongate members of the lattice-work structure incorporating the bottom baffles.

Preferably where electrolyte solution is passed through a port or ports in the side walls of the tank the height of the side baffles in relation to the depth of the electrolyte solution and the relative extent to which the side baffles are immersed in the electrolyte solution are such that cross flow of electrolyte solution is encouraged to take place over the upper edge of one side baffle, through the plurality of gaps between the electrodes and under the lower edge, or through apertures formed along or adjacent the lower edge, of the other side baffle, or vice versa.

The invention will be further illustrated by a description, by way of example, of preferred apparatus for use in a method of electrolytically refining copper by the series process, wherein unrefined electrodes are immersed in an electrolyte solution contained in a tank and maintained at a temperature of a least 63° C (145° F), with reference to the accompanying diagrammatic drawings, in which.

Figure 1:
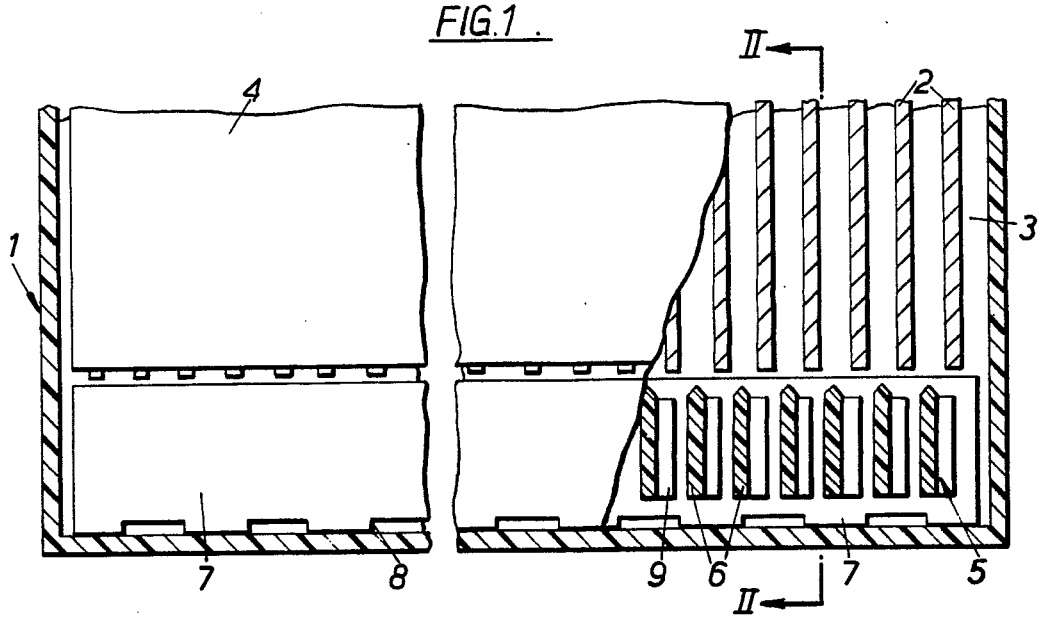
FIG. 1 is a fragmental side view, partly in section and partly in elevation, of the tank of electrolyte solution in which a group of electrodes is immersed, a side wall of the tank being omitted.
Figure 2:
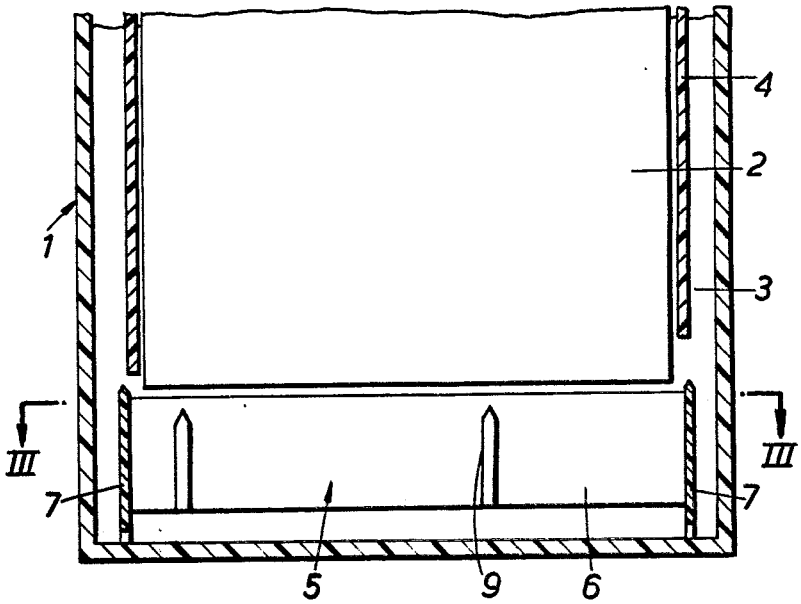
FIG. 2 is a fragmental cross-sectional view of the tank taken on the line II–II in FIG. 1.
Figure 3:
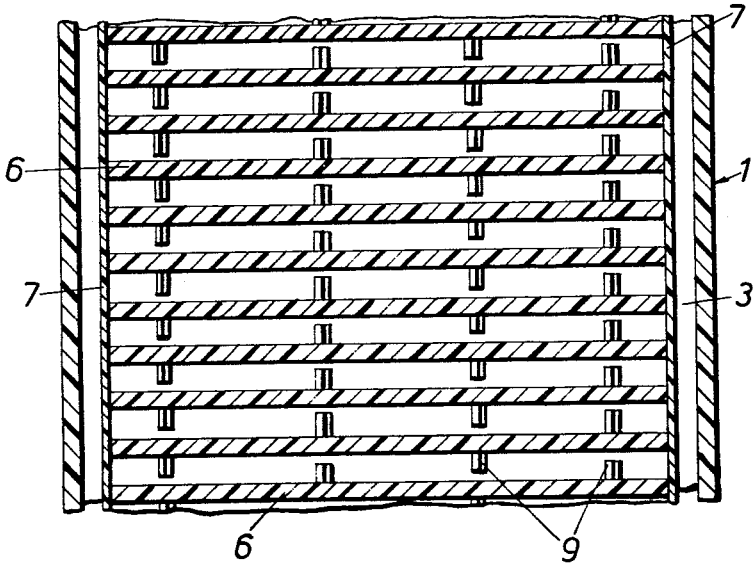
FIG. 3 is a fragmental sectional view taken on the line III–III in FIG. 2.

Referring to FIGS. 1 to 3, a group of electrodes 2 is suspended in and mutually spaced along the length of a tank 1 containing electrolyte 3 with the major surfaces of the electrodes extending transversely of the tank and arranged in substantially vertical planes and with their bottom edges spaced approximately 300 mm from the base of the tank. The tank 1 is lined with a layer of polyvinyl chloride having a thickness of 3.3 mm and has a length of 4.4 meters, a width of 1.2 meters and a depth of 2.1 meters; the electrodes have a width of 1.0 meter.

Solid sheets 4 of rigid polyvinyl chloride constituting side baffles are suspended from the support means (not shown) from which the electrodes 2 are suspended and are positioned between the side edges of the electrodes and the neighbouring side walls of the tank. Each side baffle has a height of approximately 1.65 meters, a length of approximately 4.4 meters and a thickness lying within the range 5 — 10 mm.

Positioned in the gap between the base of the tank 1 and the bottom edges of the electrodes 2 is a self-supporting lattice-work structure 5 made of rigid polyvinyl chloride and incorporating bottom baffles 6 arranged transversely of the tank 1 substantially parallel to the electrodes 2 with their major surfaces lying in vertical planes. The mutual spacing between the bottom baffles 6 is such that a bottom baffle is positioned between each pair of adjacent electrodes 2. Integral with the ends of the bottom baffles 6 are two longitudinally extending, vertically disposed strips 7 which reset on the base of the tank 1 to support the structure 5 and which have castellations 8 in the bottom edges to permit slime to settle more readily on the base of the tank. The height of the bottom baffles 6 is such that their upper edges are positioned slightly below the bottom edges of the electrodes 2 and their bottom edges are spaced from the base of the tank 1 to permit slime to settle over substantially the whole of the base of the tank. Each bottom baffle 6 has integral with each of its major surfaces two outwardly projecting fins 9 which extend over approximately two-thirds of the distance between adjacent bottom baffles. The projecting fins 9 serve to support an electrode 2 should it inadvertently drop between adjacent bottom baffles 6, thereby protecting the base of the tank from mechanical damage. The upper edge of the bottom baffles 6, the strips 7 and the projecting fins 9 are chamfered to reduce the tendency for slime to settle on them.

Figure 4:
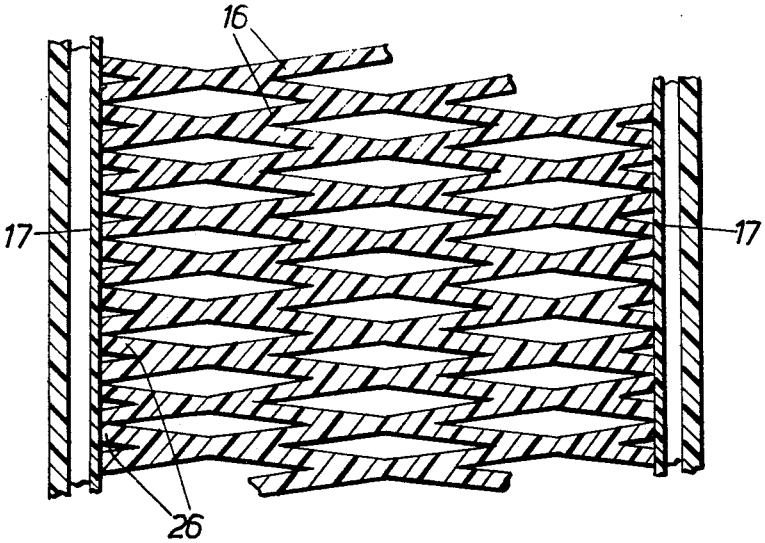
FIG. 4 is a fragmental sectional view, similar to the view shown in FIG. 3, of an alternative form of self-supporting lattice-work structure incorporating bottom baffles.

In the alternative form of self-supporting lattice-work structure shown in FIG. 4 two sets of bottom baffles 16 and 26 extend transversely of the tank and are inclined to one another and to electrodes (not shown) suspended above them. The bottom baffles 16 and 26 are integral with one another and with longitudinally extending strips 17 and are so arranged that they will support an electrode should it inadvertently drop from its support means, thereby protecting the base of the tank from mechanical damage.

What we claim as our invention is:

1. Apparatus for electrolytically refining copper by the series process comprising a tank having an inner surface of an electrically insulating synthetic polymeric material that is substantially insert to an electrolyte solution to be contained in the tank and, associated with the tank, baffles for substantially reducing current flow that would otherwise occur around at least some of the edges of electrodes when immersed in the electrolyte solution, which baffles comprise sheets of an electrically insulating material that is substantilly inert to the electrolyte solution, wherein said baffles include a pair of side baffles of such a shape and size that each can be positioned between side edges of electrodes when immersed in the tank and a neighbouring side wall of the tank throughout substantially the whole length of a group of electrodes with its major surfaces substantially vertical, and a plurality of bottom baffles in the form of a self-supporting lattice-work structure, the bottom baffles being so arranged and of such a shape and size that, when the lattice-work structure resets on the base of the tank, the bottom baffles will be mutually spaced along the length of the tank and will be positioned with their major surfaces substantially vertical in the gap between the base of the tank and the bottom edges of electrodes when immersed in the tank, with each bottom baffle extending transversely of those walls of the tank which will be adjacent the side edges of the electrodes throughout at least substantially the whole of the width of the electrodes.

2. Apparatus as claimed in claim 1, wherein the bottom baffles will extend substantially parallel to the electrodes, at least one bottom baffle being positioned below and between each adjacent pair of electrodes.

3. Apparatus as claimed in claim 2, wherein at least one of the neighbouring major surfaces of each adjacent pair of bottom baffles has projecting outwardly from the surface for a part of the distance between these major surfaces at least one fin arranged with its major surfaces substantially vertical the or each projecting fin serving to support an electrode should the electrode inadvertently drop between two adjacent bottom baffles.

4. Apparatus as claimed in claim 1, wherein the lattice-work structure comprises bottom baffles and a pair of longitudinally extending elongate members of an electrically insulating material that is substantially inert to the electrolyte solution, each of which elongate members extends along the length of the tank adjacent a side wall of the tank and is supported on the base of the tank over at least parts of its length.

5. Apparatus as claimed in claim 4, wherein the bottom edges of the bottom baffles and longitudinally extending elongate members are connected to a base wall of an electrically insulating material that is substantially inert to the electrolyte solution, said base wall being separable from the tank.

6. Apparatus as claimed in claim 1, wherein the lattice-work structure comprises two sets of transversely extending bottom baffles, the baffles of each set being inclined at an angle to one another and to electrodes when immersed in the tank.

7. Apparatus as claimed in claim 1, wherein the bottom baffles are so shaped that their bottom edges are spaced from the base of the tank over at least parts of their lengths.

8. Apparatus as claimed in claim 1, wherein the upper edges of the bottom baffles are each chamfered in order to reduce the tendency for slime to settle upon it.

9. Apparatus as claimed in claim 1, wherein each sheet of insulating material constituting a baffle is of solid form.

10. Apparatus as claimed in claim 1, wherein the baffles are of an insulating synthetic polymeric material.

11. Apparatus as claimed in claim 10, wherein the insulating synthetic polymeric material of the baffles is a polyvinyl chloride composition.

12. Apparatus as claimed in claim 1, wherein a separately formed lining of the electrically insulating polymeric material is secured to the inner surface of the wall of the tank.

13. Apparatus as claimed in claim 1, wherein the electrically insulating synthetic polymeric material of the inner surface of the tank is polyvinyl chloride.

* * * * *

UNITED STATES PATENT AND TRADEMARK OFFICE

CERTIFICATE OF CORRECTION

PATENT NO. : 4,025,413

DATED : May 24, 1977

INVENTOR(S) : Colin Walter Nightingale et al.

It is certified that error appears in the above-identified patent and that said Letters Patent are hereby corrected as shown below:

Column 2 Line 14 Delete --a--.
Column 5 Line 22 "bafles" should read --baffles--.
Column 6 Line 8 "a" (second occurrence) should read --at--.
Column 6 Line 52 "reset" should read --rest--.
Column 6 Last line "edge" should read --edges--.

Claim 1 - Column 7 Line 17 "insert" should read --inert--.
Claim 1 - Column 7 Line 23 "substantilly" should read --substantially--.
Claim 1 - Column 7 Line 34 "resets" should read --rests--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*